US007242144B2

(12) United States Patent
Kato et al.

(10) Patent No.: US 7,242,144 B2
(45) Date of Patent: Jul. 10, 2007

(54) HIGH-PRESSURE DISCHARGE LAMP, HIGH-PRESSURE DISCHARGE LAMP LIGHTING DEVICE AND AUTOMOTIVE HEADLAMP APPARATUS

(75) Inventors: Hiroyuki Kato, Yokosuka (JP); Hiromichi Kawashima, Yokosuka (JP); Kozo Uemura, Yokosuka (JP); Toshihiko Ishigami, Yokosuka (JP); Mikio Matsuda, Yokosuka (JP); Toshio Hiruta, Yokosuka (JP)

(73) Assignees: Harison Toshiba Lighting Corp., Ehime-ken (JP); Toshiba Lighting & Technology Corporation, Tokyo (JP)

( * ) Notice: Subject to any disclaimer, the term of this patent is extended or adjusted under 35 U.S.C. 154(b) by 415 days.

(21) Appl. No.: 10/485,728

(22) PCT Filed: Sep. 26, 2002

(86) PCT No.: PCT/JP02/09915

§ 371 (c)(1),
(2), (4) Date: Sep. 16, 2004

(87) PCT Pub. No.: WO03/030210

PCT Pub. Date: Apr. 10, 2003

(65) Prior Publication Data

US 2005/0040768 A1 Feb. 24, 2005

(30) Foreign Application Priority Data

Sep. 27, 2001 (JP) ..... 2001-297903

(51) Int. Cl.
*H01J 61/12* (2006.01)

(52) U.S. Cl. ..... 313/637; 313/638

(58) Field of Classification Search ..... 313/570–572, 313/637

See application file for complete search history.

(56) References Cited

U.S. PATENT DOCUMENTS 5,394,057 A 2/1995 Russell et al.
6,265,827 B1 * 7/2001 Takahashi et al. ..... 313/638

(Continued)

FOREIGN PATENT DOCUMENTS

EP 0 828 285 A2 3/1998

(Continued)

OTHER PUBLICATIONS

Toshihiko et al.; "Metal Halide Lamp"; Patent Abstracts of Japan, of JP 03-236151, Oct. 22, 1991.

(Continued)

*Primary Examiner*—Nimeshkumar D. Patel
*Assistant Examiner*—Matt Hodges
(74) *Attorney, Agent, or Firm*—Finnegan, Henderson, Farabow, Garrett & Dunner, L.L.P.

(57) ABSTRACT

The present invention provides a high-pressure discharge lamp that uses substantially no mercury and reduces discharge flicker. The high-pressure discharge lamp is kept on with a lamp power of 50 W or lower in a stable state, and the temperature T (° C.) of the electrode at a point at a distance of 0.3 mm from the tip end to the base end in the stable state and the amount A (mol/cc) of free iodine produced when the lamp is turned off after 100 hours of on-time satisfy the formula (1): $T^2/A>10^{11}$.

6 Claims, 8 Drawing Sheets

U.S. PATENT DOCUMENTS

| | | | | |
|---|---|---|---|---|
| 6,353,289 | B1 | 3/2002 | Ishigami et al. | |
| 6,515,423 | B1 * | 2/2003 | Schlager et al. | 313/639 |
| 6,653,801 | B1 * | 11/2003 | Takeda et al. | 315/246 |
| 2003/0000943 | A1 | 1/2003 | Yokozeki | |

FOREIGN PATENT DOCUMENTS

| | | | |
|---|---|---|---|
| EP | 1 032 010 | A1 | 8/2000 |
| EP | 1 063 681 | A2 | 12/2000 |
| JP | 59-111244 | | 6/1984 |
| JP | 2-7347 | | 1/1990 |
| JP | 06-84496 | | 3/1994 |
| JP | 06-162999 | | 6/1994 |
| JP | 07-296781 | | 11/1995 |
| JP | 10-261384 | | 9/1998 |
| JP | 11-238488 | | 8/1999 |
| JP | 2982198 | | 9/1999 |
| JP | 11-307048 | | 11/1999 |
| JP | 2000-149868 | A | 5/2000 |
| JP | 2000-277053 | | 10/2000 |
| JP | 2000-340178 | | 12/2000 |
| JP | 2001-6610 | | 1/2001 |
| JP | 2001-102001 | | 4/2001 |
| JP | 2001-167732 | | 6/2001 |
| JP | 2002-298780 | | 10/2002 |

OTHER PUBLICATIONS

Toshihiko et al.; "High Pressure Metalic Vaopr Electric Discharge Lamp"; Patent Abstracts of Japan, of 06-084496, Mar. 25, 1994.

Kiyoshi et al.; "Metal Halide Lamp"; Patent Abstracts of Japan, of 11-307048, Nov. 5, 1999.

International Search Report, dated Jan. 14, 2003, issued by Japanese Patent Office, for International Application No. PCT/JP02/09915.

Supplementary European Search Report issued by the European Patent Office on Jun. 29, 2006, in European Patent Application No. 02800245.

* cited by examiner

AMOUNT OF FREE IODINE PRODUCED AT THE TIME WHEN ELECTRODE TEMPERATURE IS KEPT AT 1900°C

HIGH-PRESSURE DISCHARGE LAMP, HIGH-PRESSURE DISCHARGE LAMP LIGHTING DEVICE AND AUTOMOTIVE HEADLAMP APPARATUS

TECHNICAL FIELD

The present invention relates to a high-pressure discharge lamp substantially containing no mercury, a high-pressure discharge lamp lighting device using the same, and an automotive headlamp apparatus using the same.

BACKGROUND ART

High-pressure discharge lamps which have an arc tube having a pair of opposing electrodes and containing an inert gas, a halide of a light-emitting metal and mercury, that is, metal halide lamps are used widely because of their relatively high efficiency and good color rendering. Such high-pressure discharge lamps have become widely used also as automotive headlamps. Including those used as the automotive headlamps, the high-pressure discharge lamps currently in practical use essentially uses mercury (conveniently referred to as a mercury-containing lamp, hereinafter). In Japanese Patent Laid-Open No. 2-7347, there is described an exemplary specification of a high-pressure discharge lamp used as an automotive headlamp, which specifies that about 2–15 mg of mercury has to be sealed. Besides, in Japanese Patent Laid-Open No. 59-111244, there is described a discharge lamp, that is, a high-pressure discharge lamp, suitable for the automotive headlamp which contains mercury in a predetermined amount prescribed. According to the description, when this high-pressure discharge lamp operates in a horizontal position, the discharge arc shrinks to be at least substantially linear, and the high-pressure discharge lamp is efficient.

However, nowadays environmental issues are becoming serious, and in the illuminating industry, it is considered highly important to reduce or even eliminate mercury in lamps, which applies a significant load to the environment.

To address this problem, several approaches to eliminate mercury in the high-pressure discharge lamp have been already proposed. For example, the inventors have made the inventions described in Japanese Patent No. 2982198 and Japanese Patent Laid-Open Nos. 6-84496 and 11-238488. The first invention is an arrangement which has a halide of scandium Sc or a rare earth metal and an inert gas sealed therein and is controllably turned on and off by a pulse current. The second invention is an arrangement which contains a discharge medium constituted by a metal halide and an inert gas and thus has a less variable color characteristic over a wide input range, thereby being capable of dimming illumination. The third invention is an arrangement which is improved in electrical characteristic by containing, in addition to a first metal halide, which is a primary light-emitting material, a second metal halide, which has a high vapor pressure and is hard to emit light.

Furthermore, in Japanese Patent Laid-Open No. 11-307048, there is described a high-pressure discharge lamp which avoids blackening due to scattering of the electrodes by containing, in addition to the halides of scandium Sc and sodium Na, the halides of yttrium Y and indium In as third metal halides which have a vapor pressure of $1\times10^{-5}$ atmospheres in operation and whose metals themselves are ionized at 5–10 eV. The high-pressure discharge lamp according to the invention disclosed in this document is described as having any luminous flux and chromaticity range required for the automotive headlamp.

However, when a high-pressure discharge lamp containing no mercury (conveniently, referred to as a "mercury-free lamp" hereinafter) is used as a light source of an automotive headlamp, there is a problem that the amount of light immediately after the lamp is turned on is insufficient. To address the problem, the lamp current applied immediately after the turn-on is made several times higher than that in a stable state, thereby increasing the amount of light and bringing the high-pressure discharge lamp abruptly and rapidly into the stable state.

However, in this case, another problem of discharge flicker arises. In the following, some of reasons for the discharge flicker will be described.

1. If the high-pressure discharge lamp is turned on in the manner described above, the electrodes reach the highest temperature immediately after the turn-on. Therefore, the electrodes have to be designed to withstand the temperature even if the on/off operation occurs with a relatively high frequency. As a result, in the stable state, the lamp current is relatively low, and thus, the temperature of the electrodes tends to be lower than an optimum temperature. Since the temperature of the electrodes is low in the stable state, the electrodes emit less thermoelectrons, and discharge flicker tends to occur.

If the mercury-free lamp is used as an automotive headlamp, a lamp current higher than a rated lamp current, a lamp current of 3 A, for example, has to be flown continuously for several seconds, 6 seconds, for example, immediately after the turn-on. Therefore, the electrodes have to be designed to have a further low temperature in the stable state, so that the discharge flicker becomes more noticeable. In the case of a mercury-containing lamp, the duration of application of the lamp current higher than the rated lamp current is about 1 second.

2. In the mercury-free lamp, the arc remains thin because of lack of mercury, which would make the arc thicker due to the self-absorption of the emission spectrum. Thus, the discharge flicker tends to occur.
3. If the mercury-free lamp contains a halide which has a relatively high vapor pressure and less contributes to light emission, the halide replacing mercury as a medium for providing a lamp voltage, the high vapor pressure makes the arc shrink, and thus, the discharge flicker tends to occur.
4. If the mercury-free lamp contains xenon at about 10 atmospheres to provide lamp characteristics comparable to those of a high-pressure discharge lamp containing mercury and xenon at 5–6 atmospheres, the higher xenon pressure makes the arc shrink, and thus, the discharge flicker tends to occur.
5. The mercury-free lamp produces no HgI or the like, so that a free halogen is easy to occur. However, a halide gas highly adsorbs electrons, and thus, tends to cause discharge extinction. Therefore, as the concentration of the halide gas increases, the arc becomes less stable.

As can be understood from the reasons described above, the mercury-free lamp is highly likely to suffer discharge flicker, compared with the mercury-containing lamp. In addition, such an electrode temperature that is not disadvantageous to the mercury-containing high-pressure discharge lamp may cause discharge flicker.

The discharge flicker may result in a luminance flicker, or, in an extreme case, extinction of the arc.

As a result of studies on the problems described above, the inventors have found that the arc of the mercury-free lamp can be stabilized by appropriately determining the electrode temperature and the free halogen concentration in the stable state. And based on this finding, the inventors have made the present invention.

In addition, the inventors have found that the discharge flicker in the mercury-free lamp can be effectively reduced by control the electrode temperature in such a manner that the electrode temperature in the stable state is kept within a quite narrow predetermined range.

An object of the present invention is to provide a high-pressure discharge lamp suitable for use as an automotive headlamp which substantially contains no mercury out of consideration to the environment and produces reduced discharge flicker, a high-pressure discharge lamp lighting device using the same and an automotive headlamp apparatus using the same.

Another object of the present invention is to provide a high-pressure discharge lamp suitable for use as an automotive headlamp in which discharge flicker is reduced by keeping a predetermined relationship between the electrode temperature in a stable state and the amount of free iodine produced when the lamp is off, a high-pressure discharge lamp lighting device using the same and an automotive headlamp apparatus using the same.

Another object of the present invention is to provide a high-pressure discharge lamp suitable for use as an automotive headlamp in which the electrode temperature in a stable state is kept within a predetermined narrow range to reduce discharge flicker and improve the electrode life, a high-pressure discharge lamp lighting device using the same and an automotive headlamp apparatus using the same.

DISCLOSURE OF THE INVENTION

A high-pressure discharge lamp according to the embodiment described in claim 1 is characterized in that the high-pressure discharge lamp comprises: a discharge vessel having a hermetic vessel which is fire resistant and translucent and has a discharge space therein, and a pair of electrodes hermetically provided at opposite ends of the discharge space in the hermetic vessel with facing each other at a distance of 5 mm or less; and a discharge medium substantially containing no mercury, sealed in the hermetic vessel, and containing xenon gas at 3 atmospheres or higher, and at least two of halides of light-emitting metals including iodides of sodium Na, scandium Sc and rare earth metals, the high-pressure discharge lamp is kept on with a lamp power of 50 W or lower in a stable state, and the temperature T (° C.) of the electrode at a point at a distance of 0.3 mm from the tip end to the base end in the stable state and the amount A (mol/cc) of free iodine produced when the lamp is turned off after 100 hours of on-time satisfy the formula (1).

$$T^2/A>10^{11} \quad (1)$$

Terms used in this embodiment and the embodiments described later have definitions and technical meanings as follows unless otherwise specified.

<Discharge Vessel>

The discharge vessel comprises a hermetic vessel and a pair of electrodes.

(Hermetic Vessel)

The hermetic vessel is fire resistant and translucent. The words "fire resistance" mean that the hermetic vessel can adequately withstand a normal operating temperature of the discharge lamp. Therefore, the hermetic vessel may be made of any material as far as it has a fire resistance and can allow the visible light in a desired wavelength range produced by discharge to be emitted to the outside. For example, the hermetic vessel maybe made of a ceramic, such as quartz glass, translucent alumina and YAG, or a single crystal thereof. As required, the inner surface of the hermetic vessel may be coated with a transparent film having a halogen resistance or halide resistance, or may be modified.

The hermetic vessel has a discharge space formed therein. The discharge space preferably has an elongated shape and, for example, may have a cylindrical shape. When the lamp is turned on in a horizontal position, this shape causes an arc to be bent upward and, thus, brought close to the upper inner surface of the discharge vessel, so that the temperature rises faster at the upper part of the discharge vessel.

Furthermore, a part of the hermetic vessel which surrounds the discharge space can have a relatively high thickness. That is, a part of the hermetic vessel around the middle of the distance between the electrodes can be thicker than the end parts thereof. This enhances heat transfer of the discharge vessel, whereby the temperature of the discharge medium adhering to the inner surface of the lower part and side part of the discharge space of the discharge vessel increases rapidly. Thus, a rapid rising of luminous flux is attained.

(A Pair of Electrodes)

The pair of electrodes is sealed at opposite ends of the discharge space in the hermetic vessel with facing each other at a distance of 5 mm or less. The temperature T (° C.) of the electrodes at a point at a distance of 0.3 mm from the tip ends to the base ends and the amount A (mol/cc) of the produced free iodine described later have to be determined to satisfy a predetermined relation.

The electrode temperature T (° C.) is measured with a pyrometer. Among other measurements for different points, the lowest value is adopted as the electrode temperature. For example, in the case of a high-pressure discharge lamp intended for horizontal lighting, the temperature of the electrodes is measured in the horizontal direction in a state where the lamp is on in the horizontal position. Furthermore, the reason why the electrode temperature is measured at a point at a distance of 0.3 mm from the tip end to the base end is as follows. That is, the high-pressure discharge lamp according to the present invention produces an arc of a high luminance, and therefore, it is difficult to accurately measure the electrode temperature at the tip of the electrode because of the disturbance of the arc light. On the other hand, at a point at a distance of 0.3 mm from the tip end of the electrode to the base end, the electrode temperature can be readily accurately measured.

The electrode temperature can be varied by appropriately selectively modifying one of more of design factors including the electrode diameter, the length of the part of the electrode protruding into the discharge space and the lamp voltage. Specifically, if the electrode diameter is increased, the electrode temperature decreases. If the length of the part of the electrode protruding into the discharge space is reduced, the electrode temperature decreases. If the lamp voltage is increased with the lamp power being kept constant, the lamp current decreases, resulting in a lowered electrode temperature. Thus, by appropriately setting the design factors described above, the electrode temperature can be controlled to be a desired value.

Furthermore, the electrodes may be configured for an alternating current or direct current. If the lamp is operated by an alternating current, the electrodes of the pair have the same structure. When the high-pressure discharge lamp is used as an automotive headlamp, the lamp is turned on and off extremely frequently, and a current higher than that in the stable state is supplied to the lamp at the start of lighting. Therefore, in order to fit such conditions, the diameter of the electrode can be wholly increased uniformly. However, as required, a large-diameter section may be formed only on a part of the electrode close to the tip end thereof. If the lamp is operated by a direct current, in general, the temperature of the anode increases rapidly. Thus, if the large-diameter section is formed on the part of the anode close to the tip end, the heat radiating area can be increased, and thus, the anode can be ready for a frequent on/off operation. On the other hand, the cathode may not have the large-diameter section.

<Discharge Medium>

According to the present invention, the discharge medium contains halides of light-emitting metals and xenon and substantially contains no mercury, as described above.

(Halide)

The halides are those of light-emitting metals including at least two of iodides of sodium Na, scandium Sc and rare earth metals. Sodium Na, scandium Sc and rare earth metals described above are highly efficient light emitting materials and serve as a primary light-emitting metal in this invention. Preferably, the halides used are a halide of sodium Na and at least one of halides of scandium Sc and rare earth metals. However, as required, a halide of another light-emitting metal can be additionally sealed. For example, if a halide of indium In is additionally sealed, it contributes to color adjustment because it adds a blue light component to the original light.

Now, halogens forming the halides will be described. That is, in terms of reactivity, iodine is the most suitable. At least the primary light-emitting metal described above is sealed in the hermetic vessel in the form of an iodide. However, as required, different compounds of halogens, for example iodide and bromide, may be used together. The amount A (mol) of the free iodine produced per unit volume (cc) of the inner volume of the hermetic vessel when the lamp is turned off after 100 hours of on-time and the electrode temperature T (° C.) described later have to be related to each other to satisfy the formula (1). The amount of free iodine produced can be controlled by adjusting the amount of the sealed discharge medium, modifying the method of processing of a member or the shape of the discharge vessel, or sealing a halogen getter in the hermetic vessel.

The amount A (mol/cc) of the produced free iodine is identified in the following manner. That is the identification is conducted following the process of measuring the amount of produced free iodine described in the paper entitled "Method of Early Determination of Life of Electrodeless Metal Halide Lamp", published by the inventors at the physical-properties-and-applications workshop in the Illuminating Engineering Institute of Japan in 1997.

Generally, the process is as follows.

1. A lamp to be measured is heated in an electric furnace to completely evaporate the free iodine in the discharge vessel.
2. Light emitted from a halogen lamp is made to transmit the discharge vessel, and the transmission spectrum of the transmission light is measured with an instantaneous spectrometer.
3. The transmission spectrum is divided by a reference spectrum to provide an absorption spectrum, and an absorption index is derived from the depth of absorption.
4. The amount of iodine is identified based on the measured absorption index using a calibration curve, which is previously determined based on the relationship between the absorption index and the amount of iodine.

(Xenon)

Xenon gas serves as a starting gas and a buffer gas and serves also to dominantly emit light immediately after the starting. The pressure of the sealed xenon gas is 3 atmospheres or higher, preferably is at 5 atmospheres or higher and most preferably falls within a range from 8 to 16 atmospheres. This enables a high lamp voltage of the high-pressure discharge lamp to be achieved. Thus, a higher lamp power can be provided with a same lamp current, and the rising characteristics of luminous flux can be improved. The good rising characteristics of luminous flux, which are advantageous for any use of the lamp, are extremely important particularly in applications of automotive headlamp, liquid-crystal projector and the like.

(Mercury)

The words "substantially contain no mercury" in this invention mean that mercury is not sealed at all or that mercury may exist in an amount of less than 2 mg/cc of the inner volume of the hermetic vessel, preferably 1 mg/cc of the inner volume the hermetic vessel or less. However, from an environmental point of view, it is desirable that no mercury is sealed. If the electrical characteristics of the discharge lamp are maintained by a mercury vapor as in the prior art, the mercury has to be sealed in the hermetic vessel in an amount of 20 to 40 mg/cc, possibly 50 mg/cc, of the inner volume of the hermetic vessel in the case of a short arc type high-pressure discharge lamp. Compared with this, the amount of mercury used in this invention is significantly reduced.

<Lamp Power>

In the present invention, the lamp power is a power supplied to the high-pressure discharge lamp. According to this invention, it is 50 W or lower in a stable state. This means that the high-pressure discharge lamp is a small one.

<Relationship Between Electrode Temperature and Amount of Produced Free Iodine>

If the electrode temperature T (° C.) in the stable state and the amount A (mol/cc) of the free iodine produced when the lamp is turned off after 100 hours of on-time satisfy the formula (1), a stable arc can be achieved. On the other hand, when the value of $T^2/A$ is $10^{11}$ or lower, the electrode temperature is relatively low, and the arc becomes instable, and extinction of the arc or luminance flicker is likely to occur. Therefore, the value of $T^2/A$ equal to or lower than $10^{11}$ is not allowed. In such a case, the formula (1) can be satisfied by raising the electrode temperature T (° C.), reducing the amount of the produced free iodine A (mol/cc) or appropriately taking both the measures.

$$T^2/A > 10^{11} \quad (1)$$

<Operation of the Invention>

If the lamp substantially contains no mercury, the arc is instable, and the arc extinction or a luminance flicker tends to occur. However, according to the embodiment described in claim 1, as can be apparently seen from the above description, the arc can be stabilized and the discharge flicker is effectively reduced by determining the relationship between the electrode temperature T (° C.) and the amount of the produced free iodine so as to satisfy the formula (1). As a result, the luminance flicker and the arc extinction can be significantly reduced.

The present invention is particularly suitably applied to a small high-pressure discharge lamp to which a lamp power two or more times higher than that in the stable state is supplied at the start of lighting, or a lamp current higher than a rated lamp current, that is, a lamp current of 2 A or higher, is supplied at the start of lighting.

A high-pressure discharge lamp according to the embodiment described in claim 2 is characterized in that the high-pressure discharge lamp comprises: a discharge vessel having a hermetic vessel which is fire resistant and translucent and has a discharge space therein, and a pair of electrodes hermetically provided at opposite ends of the discharge space in the hermetic vessel with facing each other at a distance of 5 mm or less; and a discharge medium substantially containing no mercury and sealed in the hermetic vessel, the high-pressure discharge lamp is kept on with a lamp power of 50 W or lower in a stable state, a lamp power two or more times higher than the lamp power in the stable state is input at the start of lighting, and the temperature T (° C.) of the electrode at a point at a distance of 0.3 mm from the tip end to the base end in the stable state satisfies the formula (2).

$$1700 \leqq T \leqq 1900 \quad (2)$$

According to this embodiment, a high-pressure discharge lamp is prescribed in which the electrode temperature in the stable state is maintained within the range defined by the formula (2), thereby reducing the discharge flicker and improving the life of the electrodes. The means for controlling the electrode temperature to fall within the predetermined range is not limited to a particular one. For example, as described with reference to the embodiment of claim 1, a desired electrode temperature can be attained by appropriately determining at least one of design factors including the electrode diameter, the length of the part of the electrode protruding into the discharge space and the lamp voltage.

In the present invention, the high-pressure discharge lamp may be an arrangement other than the metal halide lamp, as far as a lamp power two or more times higher than the lamp power in the stable state is supplied thereto at the start of lighting. Therefore, the sealed discharge medium is not limited to the halides of light-emitting metals and xenon. In addition, the inert gas may be xenon, argon, krypton or the like. The pressure of the sealed inert gas is preferably 3 atmospheres or higher.

The present invention is suitable particularly for a metal halide lamp for an automotive headlamp having sealed therein halides, preferably iodides, of light-emitting metals, preferably at least two of Na, Sc and rare earth metals, one or more of halides, preferably iodides, of metals having relatively high vapor pressures, preferably Mg, Co, Cr, Zn, Mn, Sb, Re, Ga, Sn, Fe, Al, Ti, Zr and Hf, and xenon at 3 atmospheres or higher, preferably at 5 atmospheres or higher, or more preferably at 8 to 16 atmospheres. The arrangement described in claim 1 enables the discharge flicker to be more effectively reduced for a long time and allows a long-life high-pressure discharge lamp to be provided.

Now, the electrode temperature will be described. If the electrode temperature is lower than 1700° C., the discharge is instable, and the discharge flicker occurs. On the other hand, if the electrode temperature is higher than 1900° C., the life of the electrodes is reduced, so that the life of the high-pressure discharge lamp is reduced. However, according to the present invention, since the electrode temperature falls within the range defined by the formula (2), the discharge flicker is reduced, and the high-pressure discharge lamp can have a practically sufficient lifetime.

The high-pressure discharge lamp according to the embodiment described in claim 3 is the high-pressure discharge lamp according to the embodiment of claim 2 that is further characterized in that the temperature T (° C.) of the electrode at a point at a distance of 0.3 mm from the tip end in the stable state satisfies the formula (3).

$$1730 \leqq T \leqq 1850 \quad (3)$$

According to this embodiment, a high-pressure discharge lamp is prescribed in which the electrode temperature is controlled to fall within a range narrower than that defined in claim 2, thereby further reducing the discharge flicker and further improving the life of the electrodes.

The high-pressure discharge lamp according to the embodiment described in claim 4 is the high-pressure discharge lamp described in any one of claims 1 to 3 that is further characterized in that the discharge medium contains one or more of halides of Mg, Co, Cr, Zn, Mn, Sb, Re, Ga, Sn, Fe, Al, Ti, Zr and Hf, and the one or more halides serve as media for providing a lamp voltage.

According to this embodiment, media for providing a lamp voltage that replace mercury is prescribed. These media are commonly characterized in that they have relatively high vapor pressures and emit relatively little visible light. Thus, by selectively sealing appropriate amounts of these media, a lamp voltage falling within a desired range, for example, from 20 to 70 W can be maintained. As a result, a required lamp power can be input with a relatively low lamp current.

A high-pressure discharge lamp lighting device according to the embodiment described in claim 5 is characterized in that the high-pressure discharge lamp lighting device comprises: a high-pressure discharge lamp according to any one of claims 1 to 4; and a lighting circuit in which a maximum output power within 4 seconds after the high-pressure discharge lamp is turned on is 2.5 to 4 times higher than a lamp power in a stable state.

According to this embodiment, since the maximum output power of the lighting circuit within 4 seconds after the high-pressure discharge lamp is turned on, that is, the maximum lamp power input to the high-pressure discharge lamp, is made 2.5 to 4 times higher than the lamp power in the stable state for turning on the lamp, a rapid rising of luminous flux required for an automotive headlamp can be achieved.

Assuming that the pressure of the sealed xenon falls within a range of 3 to 15 atmospheres and is denoted by X (atmospheres) and the maximum input power within 4 seconds after the high-pressure discharge lamp is turned on is denoted by AA (W), if the value of AA is determined to satisfy the following formula (4), the rising of luminous flux within 4 seconds after the lamp is turned on can be made more rapid, and a luminous intensity of 8000 cd at a representative point in the front surface of the lamp, which is required for an automotive headlamp, can be achieved.

$$AA > -2.5X + 102.5 \quad (4)$$

Such a linear relationship between the pressure of the sealed xenon and the maximum lamp power holds only when the discharge medium has a low vapor pressure. This is because, in such a case, light emission by xenon is dominant 4 seconds after the lamp is turned on. Since the amount of light emitted by xenon depends on the pressure of the sealed xenon and the power at that time, to address a xenon pressure which is too low, the input power can be increased. On the other hand, to address a xenon pressure which is too high, the input lamp power can be reduced. The high-pressure discharge lamp lighting device can be operated with an alternating current or direct current. Furthermore, it can be configured to switch from one of the alternating-current operation and the direct-current operation to the other after a lapse of a predetermined time.

Furthermore, the lighting circuit can be designed to have a no-load output voltage of 200 V or lower. In general, the lamp voltage of the high-pressure discharge lamp used in this invention is lower than that of the mercury-containing high-pressure discharge lamp, and therefore, the no-load output voltage of the lighting circuit can be 200 V or lower. This enables downsizing of the lighting circuit. Here, in the case of the mercury-containing high-pressure discharge lamp, a no-load output voltage of about 400 V is required.

Furthermore, as desired, an igniter can be added to the high-pressure discharge lamp lighting device according to the present invention.

An automotive headlamp apparatus according to the embodiment described in claim 6 is characterized in that the automotive headlamp apparatus comprises: an automotive headlamp apparatus main unit; a high-pressure discharge lamp according to any one of claims 1 to 4 which is installed in the automotive headlamp apparatus main unit with the axis of a discharge vessel thereof being aligned with an optical axis of the automotive headlamp apparatus main unit; and a lighting circuit in which a maximum output power within 4 seconds after the high-pressure discharge lamp is turned on is 2 to 4 times higher than a lamp power in a stable state.

Since the automotive headlamp apparatus of this embodiment has the high-pressure discharge lamp described in any of claims 1 to 4 as a light source, it provides a rapid rising of luminous flux and is safety. In addition, since the high-pressure discharge lamp contains no mercury, which applies a significant load to the environment, the automotive headlamp apparatus is highly preferable from an environmental viewpoint. Here, the "automotive headlamp apparatus main unit" refers to the whole of the automotive headlamp apparatus excluding the high-pressure discharge lamp and the lighting circuit.

BEST MODE FOR CARRYING OUT THE INVENTION

<First Mode for Carrying out the Embodiment Described in Claim 1>

Figure 1:
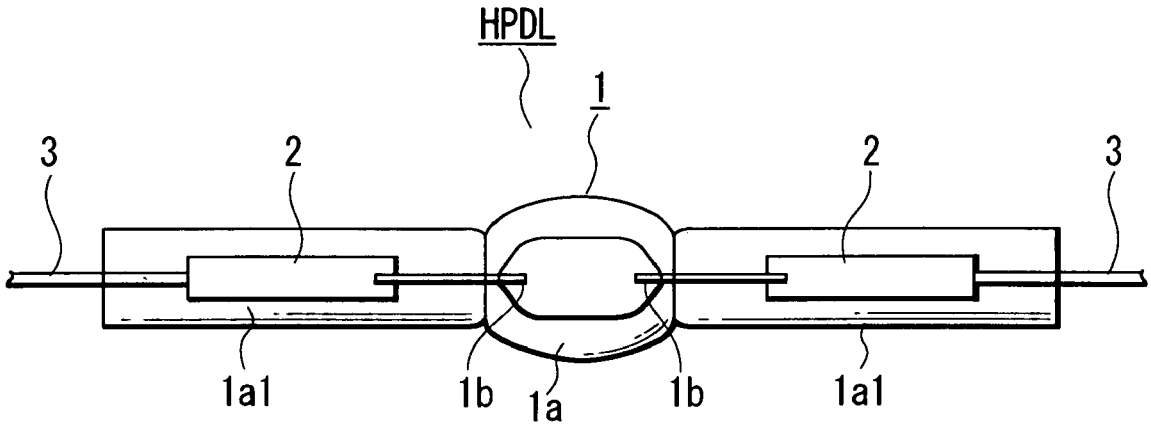
FIG. 1 is a front view of a high-pressure discharge lamp according to a first mode for carrying out the embodiment described in claim 1.

A high-pressure discharge lamp according to the first mode will be described with reference to FIG. 1. In FIG. 1, a high-pressure discharge lamp HPDL comprises a discharge vessel (1), a sealed metal foil (2), an externally introduced line (3) and a discharge medium.

The discharge vessel (1) comprises a hermetic vessel (1*a*) and a pair of electrodes (1*b*), (1*b*). The hermetic vessel (1*a*) is shaped into a hollow spindle and has a pair of elongated sealing parts (1*a*1) formed integrally therewith at both ends. The hermetic vessel (1*a*) has an elongated and substantially cylindrical discharge space (1*c*) therein. The electrodes (1*b*) are held at predetermined positions with their base portions embedded in the sealing parts (1*a*1). The base end of each electrode (1*b*) is welded to one end of the sealed metal foil (2) in the sealing part (1*a*1).

The sealed metal foil (2) is hermetically sealed in the sealing part (1*a*1) of the hermetic vessel (1*a*), and the other end of the sealed metal foil (2) is connected to the externally introduced line (3).

The discharge medium is composed of a halide of a light-emitting metal and xenon and sealed in the hermetic vessel (1*a*). Halides used are classified into a first group of halides and a second group of halides. The first group of halides includes a halide of a light-emitting metal, specifically, at least two of iodides of sodium Na, scandium Sc and rare earth metals. The second group of halides is intended to provide a lamp voltage and includes a halide of a metal which has a relatively high vapor pressure and emits less visible light. Xenon is sealed at 3 atmospheres or higher.

EXAMPLE 1

Discharge Vessel (1)

The hermetic vessel (1*a*) was made of quartz glass and had an outer diameter of 6 mm, an inner diameter of 2.7 mm.

The electrodes (1*b*) were made of tungsten, the tip ends thereof had a diameter of 0.4 mm, and the length of the parts thereof protruding into the discharge vessel was 2.3 mm.

Discharge Medium

The halides used were $ScI_3$, NaI and $ZnI_2$ in a relation of $ScI_3$–NaI–$ZnI_2$=0.2 mg.

Xenon was at 6 atmospheres.

The halogen getter used was 0.01 mg of Sc or Sb.

The lamp power in a stable state was 35 W.

The electrode temperature was 1900° C. at a point at a distance of 0.3 mm from the tip end.

The amount A of free iodine produced during 100 hours of on-time was $0.5\times10^{-6}$ (mol/cc).

The value of $T^2/A$ was $7.22\times10^{12}$.

Now, with reference to FIGS. 2 to 4, relationship among the electrode temperature T (° C.), the amount A of free iodine produced (mol/cc) and the occurrence of discharge flicker will be described.

Figure 2:
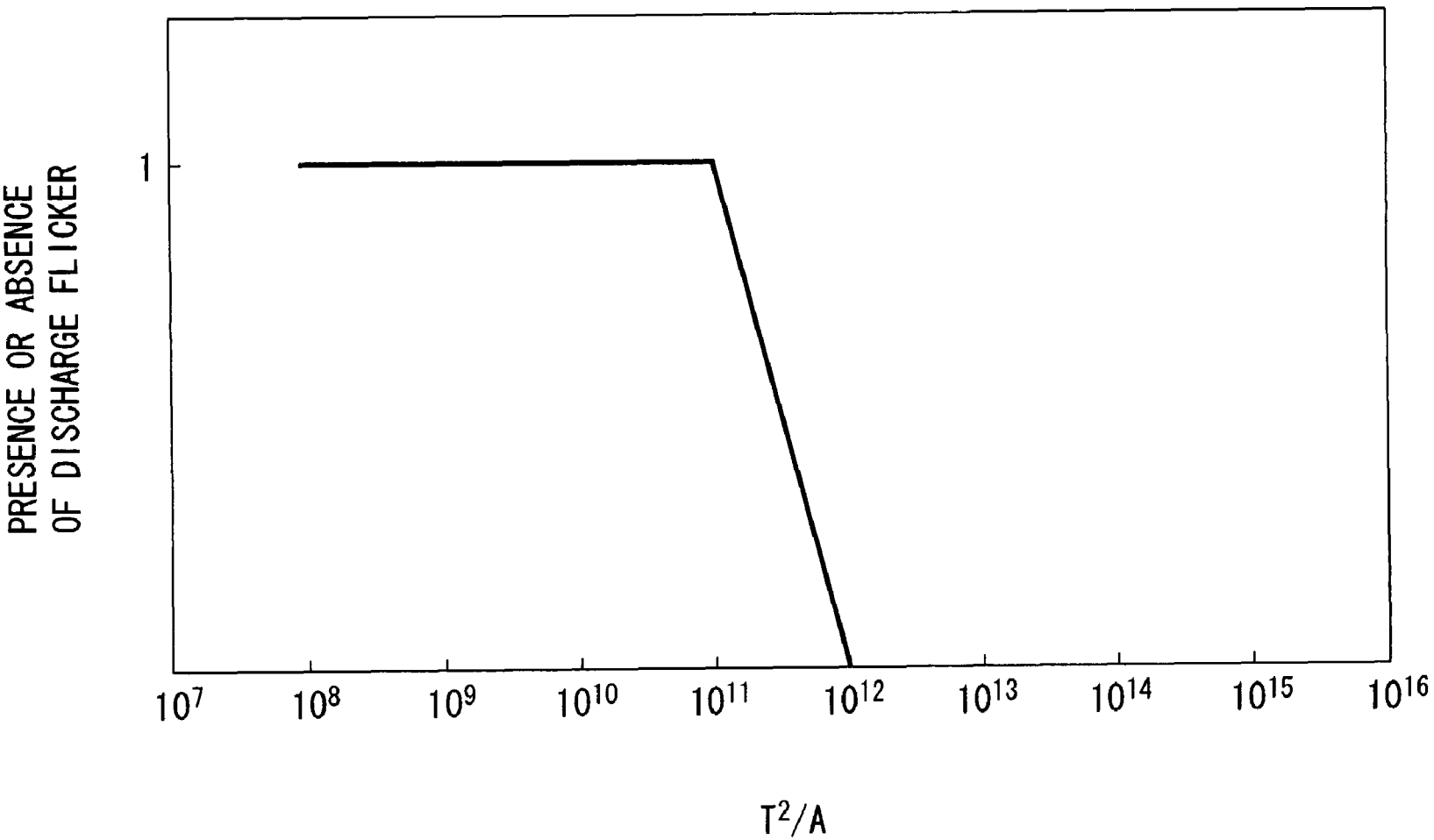
FIG. 2 is a graph showing whether a discharge flicker occurs no not when the value of $T^2/A$ is varied.

FIG. 2 shows whether the discharge flicker occurs no not when the value of $T^2/A$ is varied in the embodiment shown in FIG. 1. In this graph, the horizontal axis indicates the value of $T^2/A$, and the vertical axis indicates whether the discharge flicker occurs or not. The value of 1 on the vertical axis means the presence of the discharge flicker, and the value of 0 on the vertical axis means the absence of the discharge flicker.

As can be seen from this graph, when the value of $T^2/A$ is higher than $10^{11}$, no discharge flicker occurs.

Figure 3:
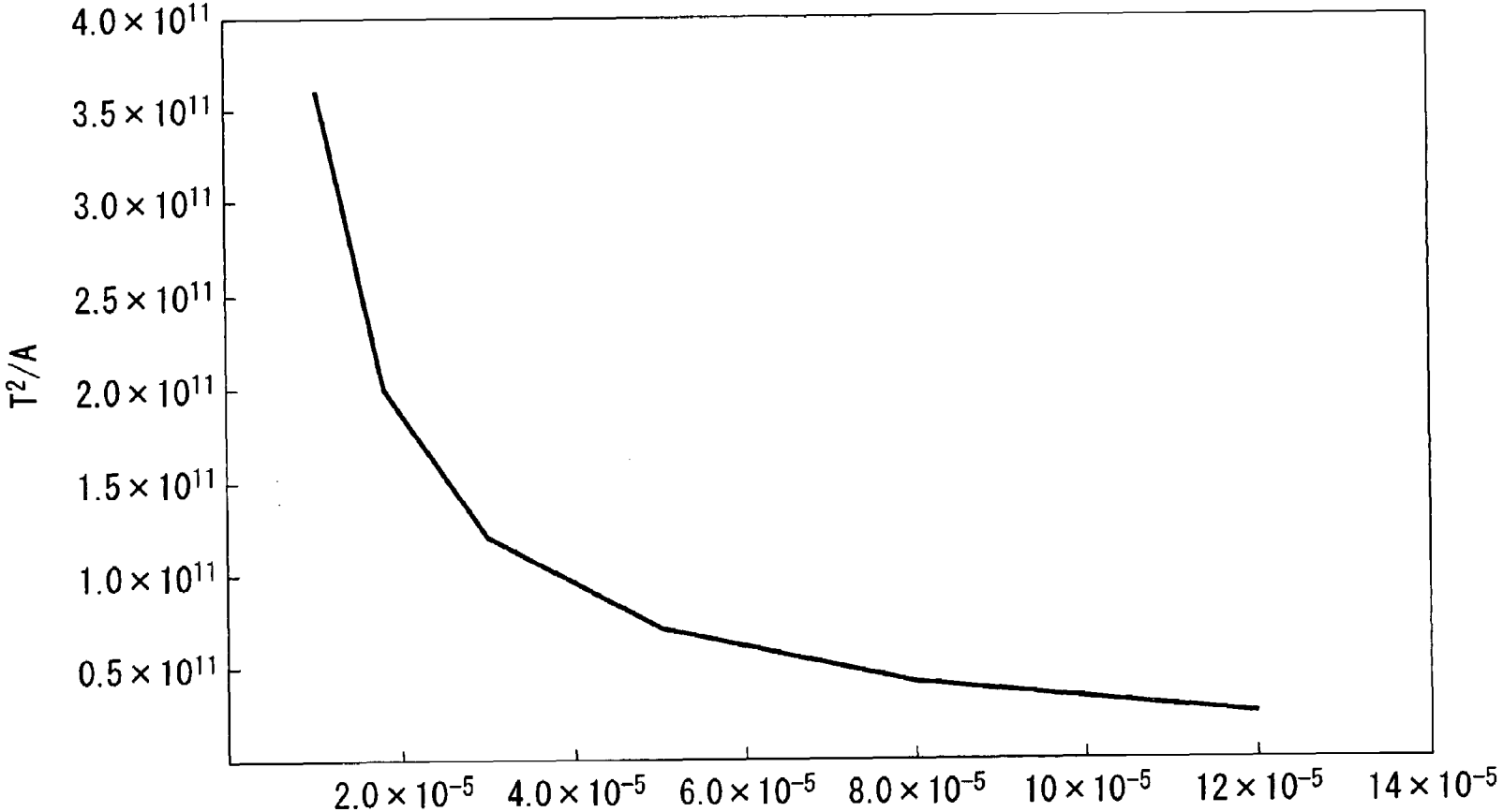
FIG. 3 is a graph showing how the value of $T^2/A$ varies when the amount of produced free iodine is varied while keeping the electrode temperature at 1900° C.

FIG. 3 shows how the value of $T^2/A$ varies when the amount of produced free iodine is varied while keeping the electrode temperature at 1900° C. In this graph, the horizontal axis indicates the amount of produced free iodine (mol/cc) when the electrode temperature is kept as 1900° C., and the vertical axis indicates the value of $T^2/A$.

As can be seen from this graph, even if the electrode temperature is 1900° C., the value of $T^2/A$ is higher than $10^{11}$ when the amount of produced free iodine is equal to or less than $3.5\times10^{-5}$ (mol/cc). This shows that, even if the electrode temperature is 1900° C., the discharge flicker can be suppressed by controlling the value of $T^2/A$ to a predetermined value.

Figure 4:
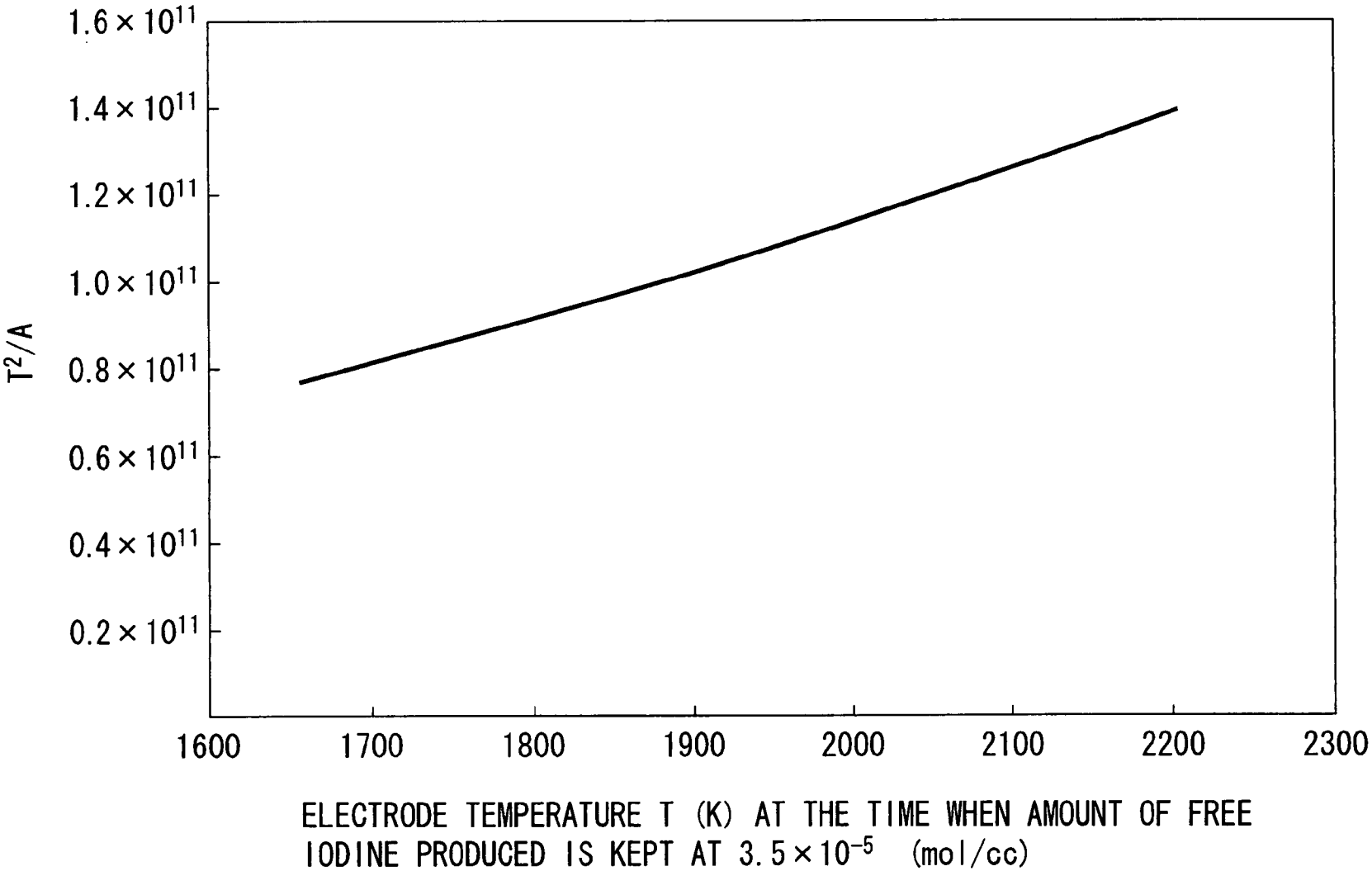
FIG. 4 is a graph showing how the value of $T^2/A$ varies when the electrode temperature is varied while keeping the amount of produced free iodine at $3.5\times10^{-5}$ (mol/cc)

FIG. 4 shows how the value of $T^2/A$ varies when the electrode temperature is varied while keeping the amount of produced free iodine at $3.5\times10^{-5}$ (mol/cc). In this graph, the horizontal axis indicates the electrode temperature T (K) at the time when the amount of produced free iodine is $3.5\times10^{-5}$ (mol/cc), and the vertical axis indicates the value of $T^2/A$.

As can be seen from this graph, when the amount of produced free iodine is $3.5\times10^{-5}$ (mol/cc), the discharge flicker cannot be adequately suppressed unless the electrode temperature is equal to or higher than 1900° C.

<First Mode for Carrying out the Embodiments Described in Claims 2 and 3>

The high-pressure discharge lamp in this first mode is apparently similar to that shown in FIG. 1. However, according to the embodiment described in claim 2, the electrode temperature is kept within a range of 1700 to 1900° C., and according to the embodiment described in claim 3, the electrode temperature is kept within a range of 1730 to 1850° C.

EXAMPLE 2

Discharge Vessel (1)

The hermetic vessel (1*a*) was made of quartz glass and had an inner volume of 0.025 cc, and the maximum inner diameter of the discharge space was 2.4 mm.

The electrodes (1*b*) were made of tungsten and had a diameter of 0.40 mm, the length of the protruding part was 1.6 mm, and the distance between the electrodes was 4.2 mm.

Discharge Medium

The halides used were $ScI_3$, NaI and $ZnI_2$ in a relation of $ScI_3$–NaI–$ZnI_2$=0.3 mg.

Xenon was at 10 atmospheres.

The lamp power immediately after the turn-on was 85 W, and the lamp power in the stable state was 35 W.

The lamp current immediately after the turn-on was 2.8 A, and the lamp current in the stable state was 0.8 A.

The electrode temperature was 1800° C. at a point at a distance of 0.3 mm from the tip end.

Figure 5:
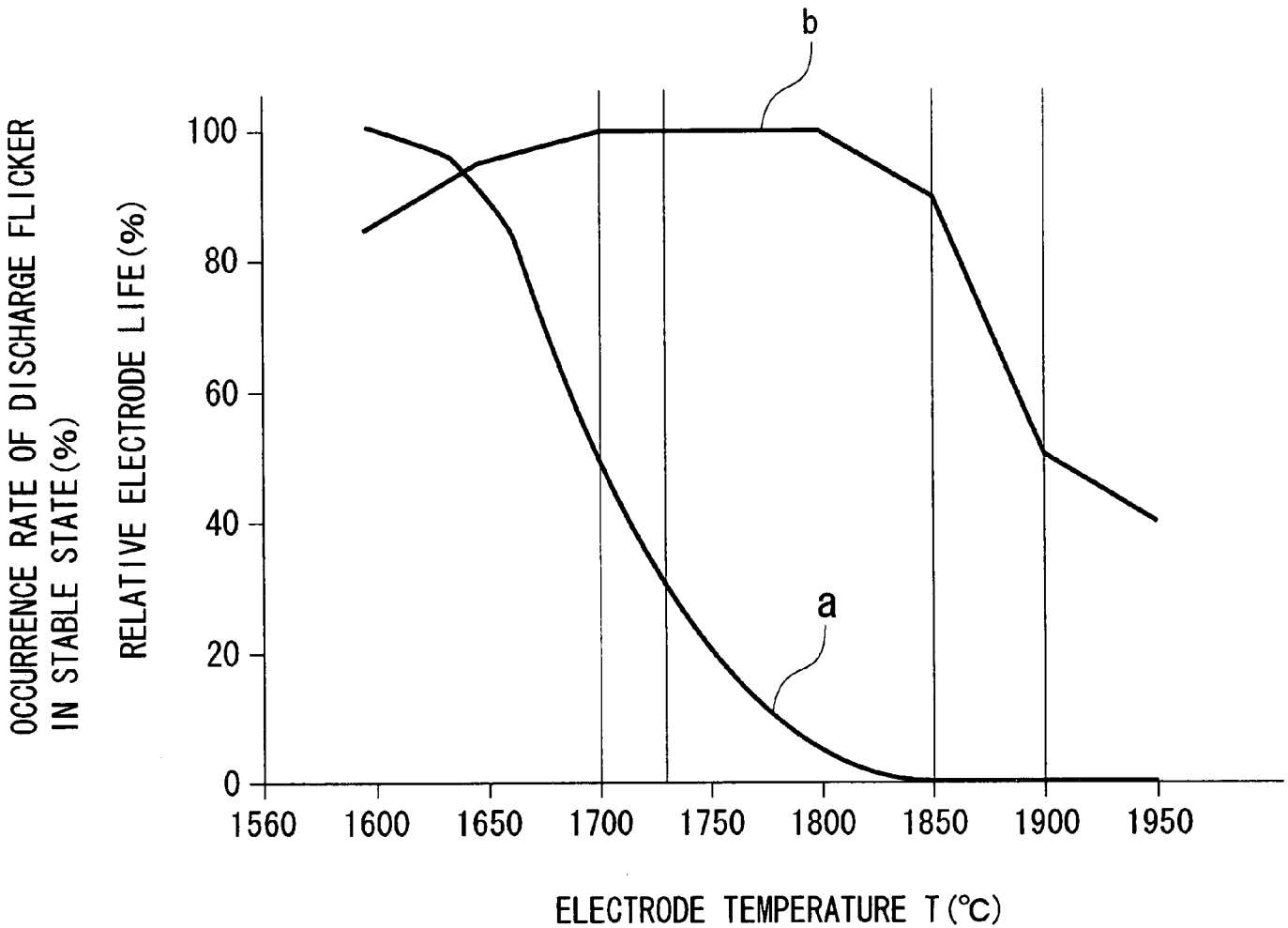
FIG. 5 is relationships between the electrode temperature in the stable state and the occurrence rate of discharge flicker and between the electrode temperature in the stable state and the relative electrode life in the first mode for carrying out the embodiments described in claims 2 and 3.

Now, with reference to FIG. 5, relationships between the electrode temperature in the stable state and the occurrence rate of discharge flicker and between the electrode temperature in the stable state and the relative electrode life in the first mode for carrying out the embodiments described in claims 2 and 3. In FIG. 5, the horizontal axis indicates the electrode temperature T (K), and the vertical axis indicates the occurrence rate (%) of discharge flicker and the relative electrode life (%). Here, the "relative electrode life" is a relative value assuming that the longest electrode life data is 100%. In this drawing, the curve a is a graph for the occurrence rate of discharge flicker, and the curve b is a line graph for the relative electrode life. These graphs are made based on measurement data obtained in turn-on tests performed on prototype high-pressure discharge lamps which follow specifications similar to those in Example 2 and exhibit various electrode temperatures.

As can be seen from FIG. 5, more discharge flicker occurs at lower electrode temperature. However, the occurrence rate is abruptly lowered once the electrode temperature rises above about 1650° C., and is reduced to 50% or lower when the electrode temperature is at or above 1700° C. Furthermore, when the electrode temperature is equal to or higher than 1730° C., the occurrence rate of discharge flicker is reduced to 30% or lower. Furthermore, when the electrode temperature is equal to or higher than 1850° C., the occurrence rate of discharge flicker is reduced to 0%.

On the other hand, the electrode life tends to be reduced once the electrode temperature drops below 1700° C. Furthermore, it is also reduced when the electrode temperature rises above about 1800° C., and is reduced below 50% when the electrode temperature rises above 1900° C.

In the embodiment described in claim 2, since the electrode temperature is equal to or higher than 1700° C. and equal to or lower than 1900° C., the occurrence rate of discharge flicker is equal to or lower than 50%, and the relative electrode life is equal to or higher than 50%, as shown in FIG. 5. On the other hand, in the embodiment described in claim 3, since the electrode temperature is prescribed to fall within a more preferred range, that is, the range of 1730 to 1850° C., the occurrence rate of discharge flicker is equal to or lower than 30%, and the relative electrode life is equal to or higher than 90%.

<Second Mode for Carrying out the Embodiments Described in Claims 1 to 4>

Now, with reference to FIG. 6, a high-pressure discharge lamp according to the second mode will be described. The high-pressure discharge lamp according to this mode is a high-pressure discharge lamp similar to that shown in FIG. 1 further configured to be installed in an automotive headlamp apparatus. Specifically, the high-pressure discharge lamp (HPDL') comprises a light-emitting tube (LT), an outer jacket (OT), a cap (B) and an insulation tube (IT).

The light-emitting tube (LT) is configured the same as the high-pressure discharge lamp (HPDL) shown in FIG. 1. The parts same as those in FIG. 1 are assigned the same reference numerals, and the descriptions thereof are omitted.

The outer jacket (OT) can block the ultraviolet rays. It houses the light-emitting tube (LT) therein and is fixed to the sealing parts (1*a*1) at the both ends. However, it is not hermetically sealed but communicated with the outside air.

The cap (B) serves both to support the light-emitting tube (LT) and the outer jacket (OT) and to electrically interconnect the pair of electrodes (1*b*), (1*b*) of the light-emitting tube (LT). That is, one of the sealing parts (1*a*1) of the light-emitting tube (LT) is secured to the cap (B), and an external lead wire (3) drawn from the other sealing part extends parallel to the outer jacket (OT) and then is introduced into the cap (B) and connected to a terminal (not shown).

The insulation tube (IT) covers the external lead wire (3).

<Embodiment Described in Claim 5>

A high-pressure discharge lamp according to this embodiment will be described with reference to FIG. 7. In this drawing, a high-pressure discharge lamp lighting device comprises a lighting circuit (OC) and a high-pressure discharge lamp (HPDL).

The lighting circuit (OC) comprises a direct-current power supply (11), a chopper (12), control means (13), lamp current detecting means (14), lamp voltage detecting means (15), an igniter (16) and a full-bridge inverter (17).

The direct-current power supply (11) is to supply a direct current power to the chopper (12) described later and may be a battery or rectified direct-current power supply. In the automotive application, a battery is typically used. Alternatively, it may be a rectified direct-current power supply that rectifies an alternating current. In any case, smoothing can be conducted with an electrolytic capacitor (11*a*) connected in parallel as required.

The chopper (12) is a DC/DC converter circuit that converts a direct-current voltage applied by the direct-current power supply (11) into a direct-current voltage of a required value, and determines the value of the output voltage to be applied to the high-pressure discharge lamp (HPDL) through the full-bridge inverter (17) described later. If the voltage of the direct-current power supply is lower than the required output voltage, a booster chopper is used. On the other hand, if the voltage is higher than the required output voltage, a step-down chopper is used.

The control means (13) incorporates a microcomputer having a programmed temporal control pattern and controls the chopper (12). For example, the control means (13) controls the chopper (12) in such a manner that, immediately after the high-pressure discharge lamp is turned on, a lamp current three or more times higher than a rated lamp current is flowed from the chopper (12) via the full-bridge inverter (17), and then with the lapse of time, the lamp current is gradually reduced to the rated lamp current. Furthermore, the control means (13) receives feedback of detection signals associated with the lamp current and lamp voltage as described later, and thus, generates a constant power control signal to perform constant power control on the chopper (12).

The lamp current detecting means (14) is inserted in series with the lamp via the full-bridge inverter (17) and detects a current corresponding to the lamp current to provide a control input to the control means (13).

Similarly, the lamp voltage detecting means (15) is connected parallel to the lamp via the full-bridge inverter (17) and detects a voltage corresponding to the lamp voltage to provide a control input to the control means (13).

The igniter (16) is interposed between the full-bridge inverter (17) and the high-pressure discharge lamp (HPDL) and configured to apply a starting pulse voltage on the order of 20 kV to the high-pressure discharge lamp (HPDL) when turning on the lamp.

The full-bridge inverter (17) comprises a bridge circuit (17*a*) consisting of four MOSFETs (Q1), (Q2), (Q3) and (Q4), a gate drive circuit (17*b*) that alternately switches between the MOSFETs (Q1) and (Q3) and the MOSFETs (Q2) and (Q4) in the bridge circuit (17*a*), and a polarity inverting circuit (17*c*). The full-bridge inverter (17) converts the direct current voltage from the chopper (12) into a rectangular low-frequency alternating current voltage by the switching and applies the resulting voltage to the high-pressure discharge lamp (HPDL) to turn on the lamp with the low-frequency alternating current.

If the high-pressure discharge lamp (HPDL) is turned on with the rectangular low-frequency alternating current by the lighting circuit (OC) in this way, the high-pressure discharge lamp produces a required luminous flux immediately after it is turned on. Thus, 25% of the rated luminous flux can be attained 1 second after the power-on and 80% of the rated luminous flux can be attained 4 seconds after the power-on, which are requirements of the automotive headlamp.

Embodiment Described in Claim 6

Figure 8:
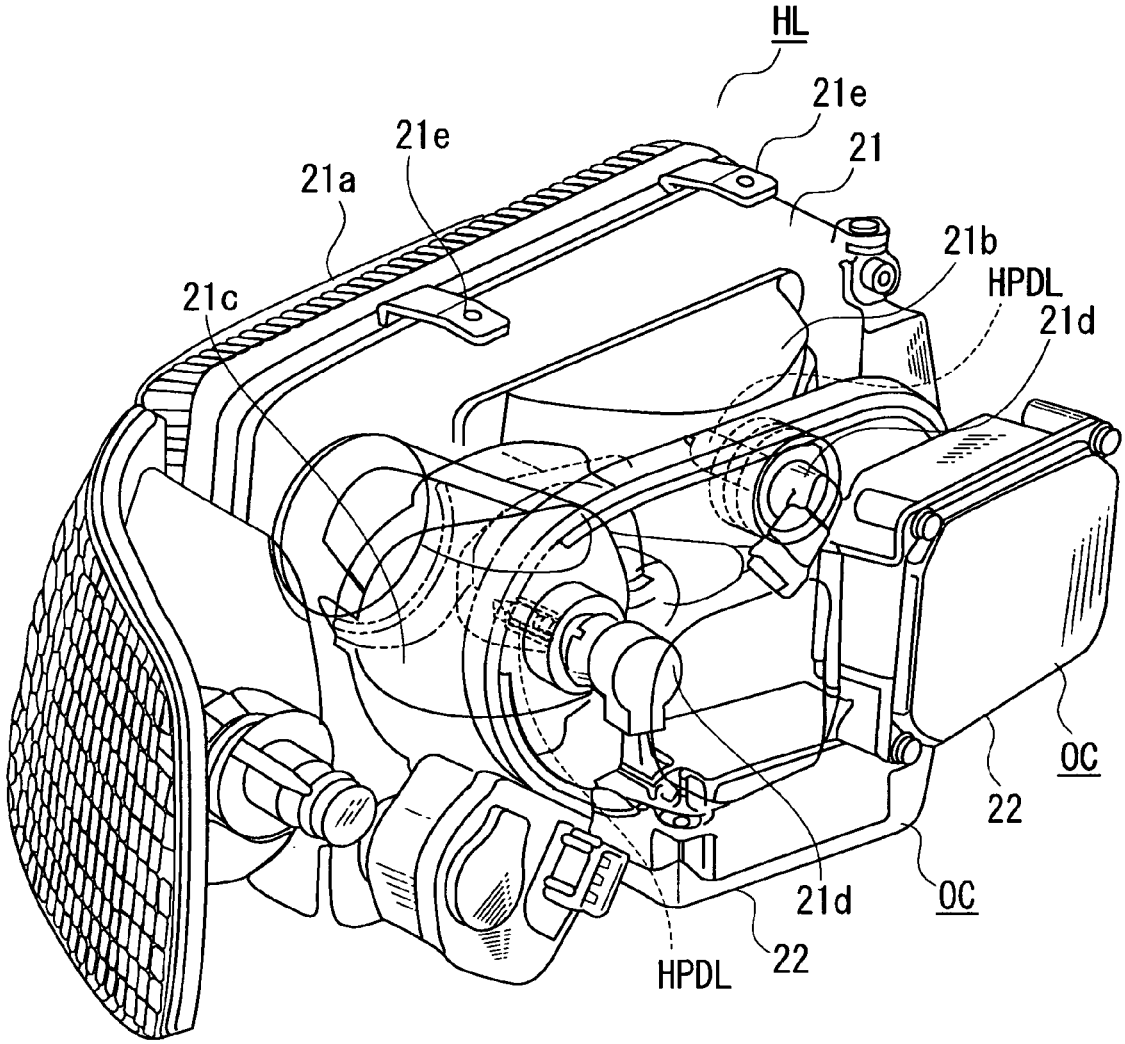
FIG. 8 is a perspective view of an automotive headlamp apparatus according to an embodiment described in claim 6.

An automotive headlamp apparatus according to this embodiment will be described with reference to FIG. 8. In this drawing, an automotive headlamp apparatus (HL) comprises an automotive headlamp apparatus main unit (21), a pair of lighting circuits (OC) and a pair of high-pressure discharge lamps (HPDL').

The automotive headlamp apparatus main unit (21) comprises a front transparent panel (21*a*), reflectors (21*b*), (21*c*), a lamp socket (21*d*) and a fixture (21*e*).

The front transparent panel (21*a*) is contoured to the shape of the outer surface of the automobile and has required optical means, for example, a prism.

Each of the reflectors (21*b*), (21*c*) is provided for each high-pressure discharge lamp (HPDL') and configured to provide required light distribution characteristics.

The lamp socket (21*d*) is connected to an output terminal of the lighting circuit (OC) and is mounted in a cap (21*d*) of the high-pressure discharge lamp (HPDL').

The fixture (21*e*) is means for fixing the automotive headlamp apparatus main unit (21) to the automobile at a predetermined position.

Figure 6:
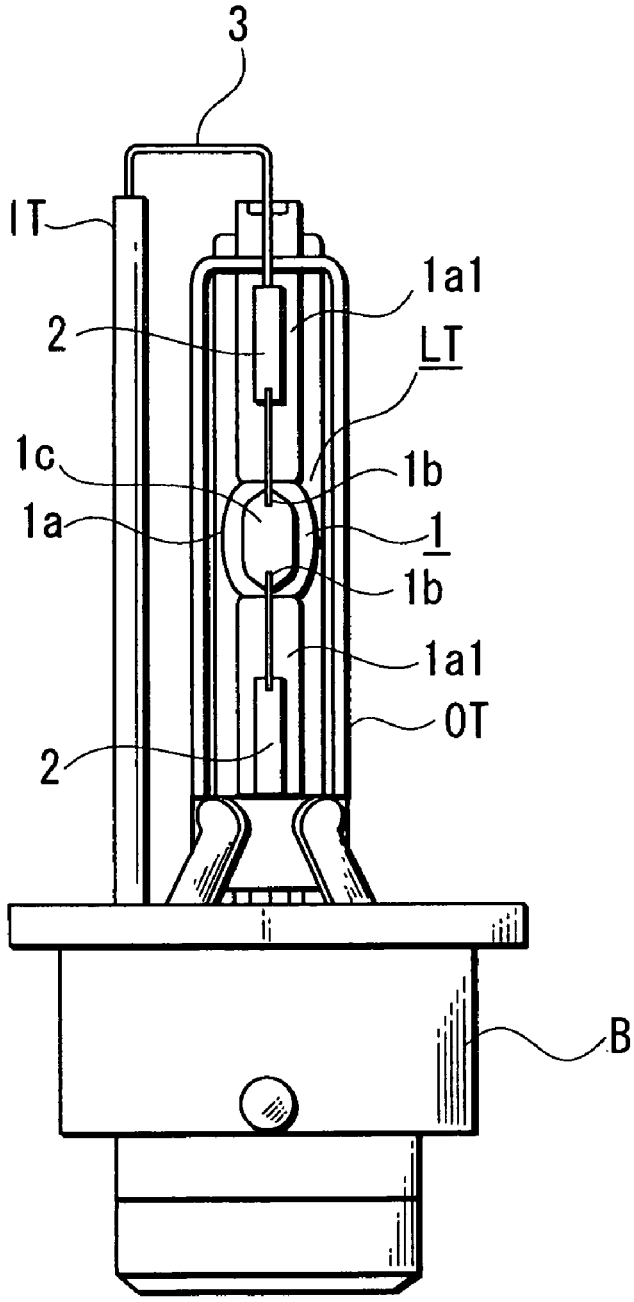
FIG. 6 is a front view of a high-pressure discharge lamp according to the second mode for carrying out the embodiments described in claims 1 to 3.

The high-pressure discharge lamp (HPDL') has the configuration described in claim 5 shown in FIG. 6. The lamp socket (21*d*) is mounted in the cap and connected thereto.

In this way, the two-bulb high-pressure discharge lamp (HPDL') is mounted in the automotive headlamp apparatus main unit (21), resulting in the four-bulb automotive headlamp apparatus (HL). The light emitting parts of each high-pressure discharge lamp (HPDL') are located generally at focal points of the reflectors (21*b*), (21*c*) of the automotive headlamp apparatus main unit (21).

Figure 7:
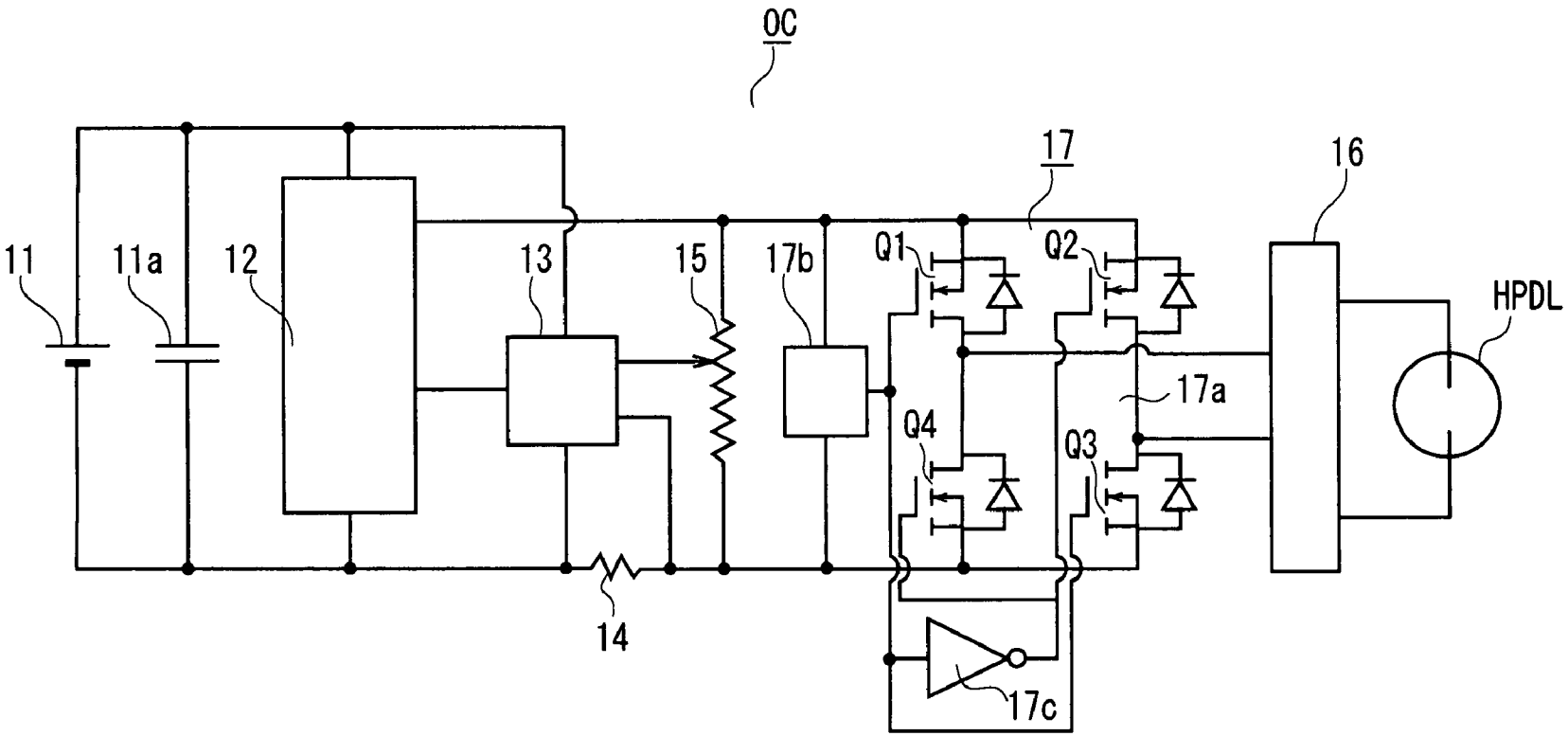
FIG. 7 is a circuit diagram of a high-pressure discharge lamp lighting device according to an embodiment described in claim 5.

The lighting circuits (OC), which have the circuit arrangement shown in FIG. 7, are housed in metallic vessels (22) and energize the respective high-pressure discharge lamps (HPDL') to turn them on.

INDUSTRIAL APPLICABILITY

According to the embodiment described in claim 1, since the electrode temperature T (° C.) at a point at a distance of 0.3 mm from the tip end to the base end in the stable state and the amount A (mol/cc) of free iodine produced when the lamp is turned off after 100 hours of on-time satisfy the formula (1), the arc is stabilized, and the arc extinction or luminance flicker is reduced. Thus, there can be provided a high-pressure discharge lamp suitable for use as an automotive headlamp in which a lamp power two or more times higher than a lamp power in the stable state is input thereto at the start of lighting.

$$T^2/A > 10^{11} \quad (1)$$

According to the embodiment described in claim 2, since the electrode temperature T (° C.) at a point at a distance of 0.3 mm from the tip end to the base end in the stable state satisfies the formula (2), the discharge flicker is suppressed, and the electrodes can have a relatively long life. Thus, there can be provided a high-pressure discharge lamp suitable for use as an automotive headlamp in which a lamp power two or more times higher than a lamp power in the stable state is input thereto at the start of lighting.

$$1700 \leqq T \leqq 1900 \quad (2)$$

According to the embodiment described in claim 3, since the electrode temperature T (° C.) at a point at a distance of 0.3 mm from the tip end to the base end in the stable state satisfies the formula (3), the discharge flicker is further effectively suppressed, and the electrodes can have a longer life. Thus, there can be provided a high-pressure discharge lamp suitable for use as an automotive headlamp in which a lamp power two or more times higher than a lamp power in the stable state is input thereto at the start of lighting.

$$1730 \leqq T \leqq 1850 \quad (3)$$

According to the embodiment described in claim 4, in addition to the characteristics described concerning the embodiments of claims 1 to 3, the discharge medium contains one or more of halides of Mg, Co, Cr, Zn, Mn, Sb, Re, Ga, Sn, Fe, Al, Ti, Zr and Hf, and the one or more halides serve as a medium for providing a lamp voltage. Thus, there can be provided a high-pressure discharge lamp which can be adequately used for various applications including the automotive headlamp with using substantially no mercury, which applies a significant load to the environment.

According to the embodiment described in claim 5, there can be provided a high-pressure discharge lamp lighting device having the advantages of the embodiments of claims 1 to 4 in which the discharge flicker of the high-pressure is reduced and a good rising of luminous flux is achieved.

According to the embodiment described in claim 6, there can be provided an automotive headlamp apparatus having the advantages of the embodiments of claims 1 to 4 in which a good rising of luminous flux is achieved.

The invention claimed is:

1. A high-pressure discharge lamp, characterized in that the high-pressure discharge lamp comprises:

a discharge vessel having a hermetic vessel which is fire resistant and translucent and has a discharge space therein, and a pair of electrodes hermetically provided at opposite ends of the discharge space in the hermetic vessel facing each other at a distance of 5 mm or less; and a discharge medium substantially containing no mercury, sealed in the hermetic vessel, and containing xenon gas at 3 atmospheres or higher, and at least two of halides of light-emitting metals including iodides of sodium (Na), scandium (Sc), and rare earth metals, the high-pressure discharge lamp is kept on with a lamp power of 50 W or lower in a stable state, and the temperature T (° C.) of the electrode at a point at a distance of 0.3 mm from the tip end to the base end in the stable state and the amount A (mol/cc) of free iodine produced when the lamp is tumed off after 100 hours of on-time satisfy the formula (1):

$$T^2/A > 10^{11} \quad (1).$$

2. A high-pressure discharge lamp, characterized in that the high-pressure discharge lamp comprises:

a discharge vessel having a hermetic vessel which is fire resistant and translucent and has a discharge space therein, and a pair of electrodes hermetically provided at opposite ends of the discharge space in the hermetic vessel facing each other at a distance of 5 mm or less; and a discharge medium substantially containing no mercury and sealed in the hermetic vessel, the high-pressure discharge lamp is kept on with a lamp power of 50 W or lower in a stable state, a lamp power two or more times higher than the lamp power in the stable state is input at the start of lighting, and the temperature T (° C.) of the electrode at a point at a distance of 0.3 mm from the tip end to the base end in the stable state satisfies the formula (2):

$$1700 \leqq T \leqq 1900 \quad (2).$$

3. The high-pressure discharge lamp according to claim 2, characterized in that the temperature T (° C.) of the electrode at a point at a distance of 0.3 mm from the tip end in the stable state satisfies the formula (3):

$$1730 \leqq T \leqq 1850 \quad (3).$$

4. The high-pressure discharge lamp according to any one of claims 1 to 3, characterized in that the discharge medium contains one or more of halides of Mg, Co, Cr, Zn, Mn, Sb, Re, Ga, Sn, Fe, Al, Ti, Zr and Hf, and the one or more halides serve as a medium for providing a lamp voltage.

5. A high-pressure discharge lamp lighting device, characterized in that the high-pressure discharge lamp lighting device comprises:

a high-pressure discharge lamp according to claim 1 or 2; and a lighting circuit in which a maximum output power within 4 seconds after the high-pressure discharge lamp is turned on is 2.5 to 4 times higher than a lamp power in a stable state.

6. An automotive headlamp apparatus, characterized in that the automotive headlamp apparatus comprises:

an automotive headlamp apparatus main unit;

a high-pressure discharge lamp according to claim 1 or 2 which is installed in the automotive headlamp apparatus main unit with the axis of a discharge vessel thereof being aligned with an optical axis of the automotive headlamp apparatus main unit; and a lighting circuit in which a maximum output power within 4 seconds after the high-pressure discharge lamp is turned on is 2 to 4 times higher than a lamp power in a stable state.

* * * * *